US007787638B2

(12) United States Patent
Lokki et al.

(10) Patent No.: US 7,787,638 B2
(45) Date of Patent: Aug. 31, 2010

(54) METHOD FOR REPRODUCING NATURAL OR MODIFIED SPATIAL IMPRESSION IN MULTICHANNEL LISTENING

(75) Inventors: Tapio Lokki, Helsinki (FI); Juha Merimaa, Espoo (FI); Ville Pulkki, Espoo (FI)

(73) Assignee: Fraunhofer-Gesellschaft zur Forderung der Angewandten Forschung E.V., Munich (DE)

( * ) Notice: Subject to any disclaimer, the term of this patent is extended or adjusted under 35 U.S.C. 154(b) by 356 days.

(21) Appl. No.: 10/547,151

(22) PCT Filed: Feb. 25, 2004

(86) PCT No.: PCT/FI2004/000093

§ 371 (c)(1),
(2), (4) Date: Aug. 26, 2005

(87) PCT Pub. No.: WO2004/077884

PCT Pub. Date: Sep. 10, 2004

(65) Prior Publication Data

US 2006/0171547 A1 Aug. 3, 2006

(30) Foreign Application Priority Data

Feb. 26, 2003 (FI) ..... 20030294

(51) Int. Cl.
*H04R 3/00* (2006.01)

(52) U.S. Cl. ..... 381/92; 381/26; 381/91; 367/12; 367/119

(58) Field of Classification Search ..... 381/58–59, 381/61, 63, 91–92, 94.1, 94, 3, 94.3, 17–18, 381/1, 66, 26, 122, 356; 367/12, 118–119, 367/125

See application file for complete search history.

(56) References Cited

U.S. PATENT DOCUMENTS 4,392,019 A 7/1983 Halliday
4,731,848 A * 3/1988 Kendall et al. ..... 381/63

(Continued)

FOREIGN PATENT DOCUMENTS

EP 0869697 10/1998

(Continued)

OTHER PUBLICATIONS

Japanese Office Action in Corresponding 2006-502072 Dated Nov. 27, 2009.

*Primary Examiner*—Vivian Chin
*Assistant Examiner*—Disler Paul
(74) *Attorney, Agent, or Firm*—Young & Thompson

(57) ABSTRACT

The invention concerns a method for reproducing spatial impression of existing spaces in multichannel or binaural listening. It consists of following steps/phases: a) Recording of sound or impulse response of a room using multiple microphones, b) Time- and frequency-dependent processing of impulse responses or recorded sound, c) Processing of sound to multichannel loudspeaker setup in order to reproduce spatial properties of sound as they were in recording room, and (alternative to c), d) Processing of impulse response to multichannel loudspeaker setup, and convolution between rendered responses and an arbitrary monophonic sound signal to introduce the spatial properties of the measurement room to the multichannel reproduction of the arbitrary sound signal, and is applied in sound studio technology, audio broadcasting, and in audio reproduction.

24 Claims, 2 Drawing Sheets

U.S. PATENT DOCUMENTS

Figure 1:
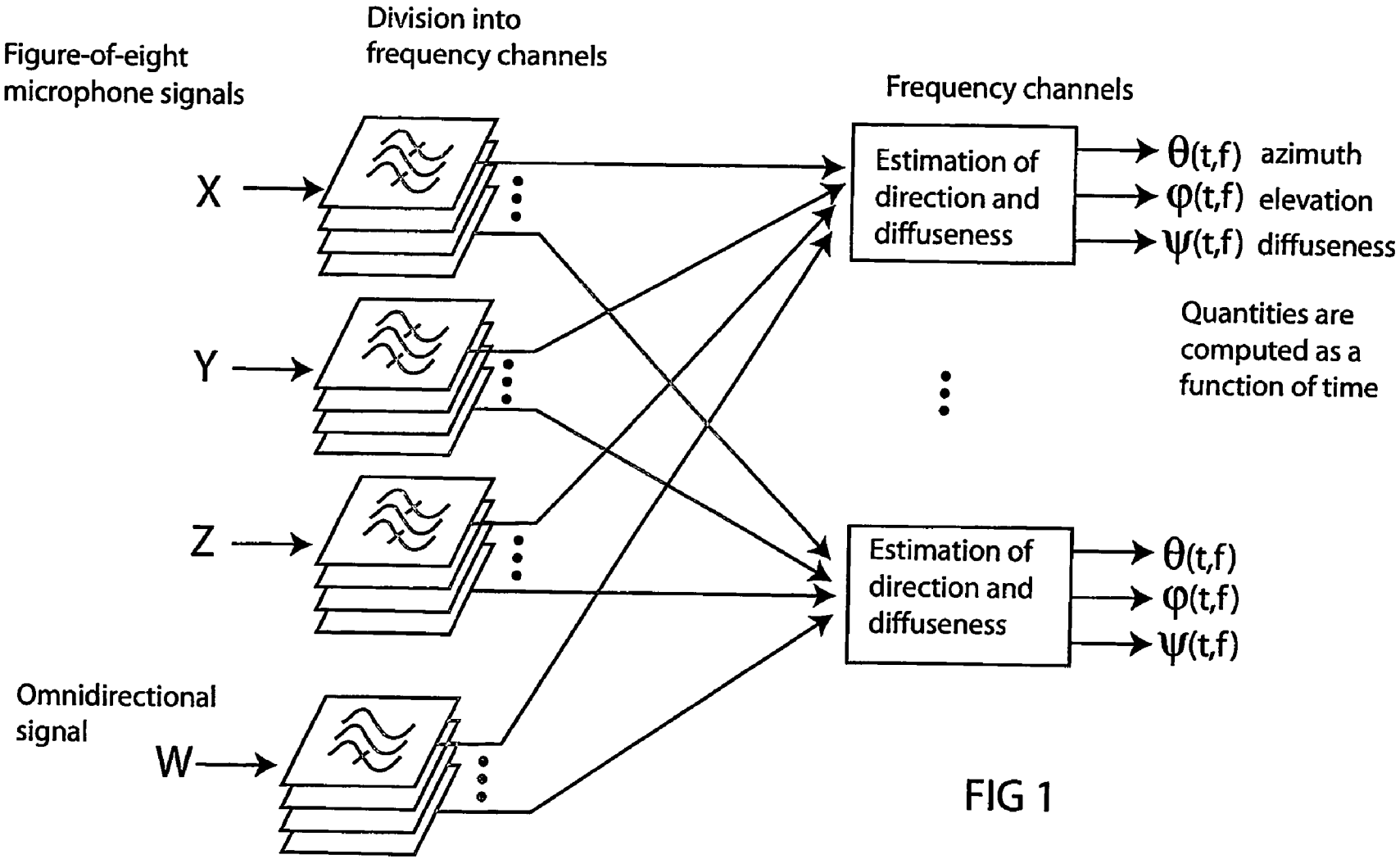

| | | | | |
|---|---|---|---|---|
| 5,020,098 | A | 5/1991 | Celli | |
| 5,195,140 | A * | 3/1993 | Kudo et al. | 381/94.3 |
| 5,778,082 | A * | 7/1998 | Chu et al. | 381/92 |
| 5,812,674 | A | 9/1998 | Jot et al. | |
| 6,130,949 | A * | 10/2000 | Aoki et al. | 381/94.3 |
| 6,222,927 | B1 * | 4/2001 | Feng et al. | 381/94.2 |
| 6,317,501 | B1 * | 11/2001 | Matsuo | 381/92 |
| 6,442,277 | B1 | 8/2002 | Lueck et al. | |
| 683,923 | A1 | 11/2002 | Marsh | |
| 6,738,481 | B2 * | 5/2004 | Krasny et al. | 381/94.1 |
| 6,842,524 | B1 * | 1/2005 | Kobayashi | 381/1 |
| 6,845,163 | B1 * | 1/2005 | Johnston et al. | 381/92 |
| 6,904,358 | B2 * | 6/2005 | Nohara et al. | 701/201 |
| 6,987,856 | B1 * | 1/2006 | Feng et al. | 381/92 |
| 6,990,205 | B1 * | 1/2006 | Chen | 381/17 |
| 2001/0031053 | A1 * | 10/2001 | Feng et al. | 381/92 |
| 2002/0067835 | A1 * | 6/2002 | Vatter | 381/58 |
| 2002/0150263 | A1 * | 10/2002 | Rajan | 381/92 |
| 2003/0035553 | A1 * | 2/2003 | Baumgarte et al. | 381/94.2 |

FOREIGN PATENT DOCUMENTS

| | | |
|---|---|---|
| GB | 2373956 | 10/2002 |
| JP | 4-296200 | 10/1992 |
| JP | 5-268693 | 10/1993 |
| JP | 2002-78100 | 3/2002 |
| WO | WO 93/18630 | 9/1993 |
| WO | WO 98/58523 | 12/1998 |

* cited by examiner

METHOD FOR REPRODUCING NATURAL OR MODIFIED SPATIAL IMPRESSION IN MULTICHANNEL LISTENING

The invention concerns a method for reproducing spatial impression of existing spaces in multichannel or binaural listening. It consists of following steps/phases:

1. Recording of sound or impulse response of a room using multiple microphones,
2. Time- and frequency-dependent processing of impulse responses or recorded sound,
3. Processing of sound to multichannel loudspeaker setup in order to reproduce spatial properties of sound as they were in recording room,
4. (alternative to 3.) Processing of impulse response to multichannel loudspeaker setup, and convolution between rendered responses and an arbitrary monophonic sound signal to introduce the spatial properties of the measurement room to the multichannel reproduction of the arbitrary sound signal, and is applied in sound studio technology, audio broadcasting, and in audio reproduction.

When listening to sound, a human listener always perceives some kind of a spatial impression. The listener can detect both the direction and the distance of a sound source with certain precision. In a room, the sound of the source evokes a sound field consisting of the sound emanating directly from the source, as well as of reflections and diffraction from the walls and other obstacles in the room. Based on this sound field, the human listener can make approximate deductions about several physical and acoustical properties of the room. One goal of sound technology is to reproduce these spatial attributes as they were in a recording space. Currently, the spatial impression cannot be recorded and reproduced without considerable degradation of quality.

The mechanisms of human hearing are fairly well known. The physiology of the ear determines the frequency resolution of hearing. The wide-band signals arriving at the ears of a listener are analyzed using approximately 40 frequency bands. The perception of spatial impression is mainly based on the interaural time difference (ITD) and interaural level difference (ILD), that are also analyzed within the previously mentioned 40 frequency bands. The ITD and ILD are also called localization cues. In order to reproduce the inherent spatial information of a certain acoustical environment, similar localization cues need to be created during the reproduction of sound.

Consider first loudspeaker systems and the spatial impression that can be created with them. Without special techniques, common two-channel stereophonic setups can only create auditory events on the line connecting the loudspeakers. Sound emanating from other directions cannot be produced. Logically by using more loudspeakers around the listener, more directions can be covered and a more natural spatial impression can be created. The most well known multichannel loudspeaker system and layout is the 5.1 standard (ITU-R 775-1), which consists of five loudspeakers at azimuth angles of 0°, ±30° ja ±110° with respect to each other. Other systems with varying number of loudspeakers located at different directions have also been proposed. Some existing systems, especially in theaters and sound installations, also include loudspeakers at different heights.

Several different recording methods have been designed for the previously mentioned loudspeaker systems, in order to reproduce the spatial impression in the listening situation as it would be perceived in the recording environment. The ideal way to record spatial sound for a chosen multichannel loudspeaker system would be to use the same number of microphones as there are loudspeakers. In such a case, the directivity patterns of the microphones should also correspond to the loudspeaker layout such that sound from any single direction would only be recorded with one, two, or three microphones. The more loudspeakers are used, the narrower directivity patterns are thus needed. However, current microphone technology cannot produce as directional microphones as would be needed. Furthermore, using several microphones with too broad directivity patterns results in a colored and blurred auditory perception, due to the fact that sound emanating from a single direction is always reproduced with a greater number of loudspeakers than necessary. Hence, current microphones are best suited for two-channel recording and reproduction without the goal of a surrounding spatial impression.

The problem is, how to record spatial sound to be reproduced with varying multichannel loudspeaker systems.

If the microphones are placed close to sound sources, the acoustics of the recording room have little effect on the recorded signals. In such a case, the spatial impression is added or created with reverberators while mixing the sound. If the sound is supposed to produce a perception as if it were recorded in a specific acoustical environment, the acoustics can be simulated by measuring a multichannel impulse response and convolving it with the source signal using a reverberator. This method produces loudspeaker signals that correspond to recording the sound source in the acoustical environment where the impulse responses were measured. The problem is then, how to create appropriate impulse responses for the reverberator.

The invention is a general method for reproducing the acoustics of any room or acoustical environment using an arbitrary multichannel loudspeaker system. This method produces a sharper and more natural spatial impression than can be achieved with existing methods. The method also enables improvement of the acquired acoustics by modifying certain room acoustical parameters.

Earlier Methods

As pertaining to multichannel loudspeaker systems, spatial impression has earlier been created with ad hoc methods invented by professional sound engineers. These methods include utilization of several reverberators and mixing the sound recorded with microphones placed both close to and far away from sound sources in the recording environment. Such methods cannot accurately reproduce any specific acoustical environment, and the final result may sound artificial. Furthermore, the sound always needs to be mixed for a chosen loudspeaker setup and it cannot be directly converted to be reproduced with a different loudspeaker system.

Two main principles for recording spatial sound have been proposed in the literature, see, e.g. [1].

The first principle utilizes one microphone per each loudspeaker in the reproduction system with intermicrophone distances of more than 10 cm. Some related problems have already been discussed. This kind of techniques create good overall spatial impression, but the perceived directions of the reproduced sound events are vague and their sound may be colored. When using a large number of loudspeakers, it is nearly impossible to use as many microphones in the recording situation. Furthermore, the loudspeaker setup has to be known precisely in advance, and the recorded sound cannot be reproduced with different loudspeaker setups or reproduction systems.

The second group of methods applies directional microphones positioned as close to each other as possible. There are two commercial microphone systems, known as the SoundField and Microflown microphones, that are specifically designed for recording spatial sound. These systems can record an omnidirectional response (W) and three directional responses (X,Y,Z) with figure-of-eight directivity patterns aligned in the directions of the corresponding Cartesian coordinate axes. Using these responses, it is possible to create "virtual microphone signals" corresponding to any first-order differential directivity pattern (figure-of-eight, cardioid, hypercardioid, etc.) pointing at any direction.

Ambisonics technology is based on using such virtual microphones. Sound is recorded with a SoundField microphone or an equivalent system, and during reproduction, one virtual microphone is directed towards each loudspeaker. The signals of these virtual microphones are fed to the corresponding loudspeakers. Since first-order directivity patterns are broad, sound emanating from any distinct direction is always reproduced with almost all loudspeakers. Thus, there is plenty of cross-talk between the loudspeaker channels. Consequently, the listening area where the best spatial impression can be perceived is small, and the directions of the perceived auditory events are vague and their sound is colored.

THE INVENTION

The purpose of the invention is to reproduce the spatial impression of an existing acoustical environment as precisely as possible using a multichannel loudspeaker system. Within the chosen environment, responses (continuous sound or impulse responses) are measured with an omnidirectional microphone (W) and with a set of microphones that enables to measure the direction-of-arrival of sound. A common method is to apply three figure-of-eight microphones (X,Y,Z) aligned with the corresponding Cartesian coordinate axes. The most practical way to do this is to use a SoundField or a Microflown system, which directly yield all the desired responses.

In the proposed method, the only sound signal fed to the loudspeakers is the omnidirectional response W. Additional responses are used as data to steer W to some or all loudspeakers depending on time.

In the invention, the acquired signals are divided into frequency bands, e.g., using a resolution of the human hearing or better. This can be realized, e.g., with a filterbank or by using short-time Fourier transform. Within each frequency band, the direction of arrival of the sound is determined as a function of time. Determination is based on some standard method, such as estimation of sound intensity, or some cross-correlation-based method [2]. Based on this information, the omnidirectional response is positioned to the estimated direction. Positioning here denotes methods to place a monophonic sound to some direction regarding to the listener. Such methods are, e.g., pair- or triplet-wise amplitude panning [3], Ambisonics [4], Wave Field Synthesis [5] and binaural processing [6].

With such processing it can be assumed that at each time instant at each frequency band similar localization cues are conveyed to the listener as would appear in the recording space. Thus, the problem of too wide microphone beams is overcome. The method effectively narrows the beams according to the reproduction system.

The method, as described previously, is nevertheless not good enough. It assumes that the sound is always emanating from a distinct direction. This is not the case for example in diffuse reverberation. In the invention, this is solved by estimating at each frequency band at each time instant also the diffuseness of sound, in addition to the direction of arrival. If the diffuseness is high, a different spatialization method is used to create a diffuse impression. If the direction of sound is estimated using sound intensity, the diffuseness can be derived from the ratio of the magnitude of the active intensity to the sound power. When the calculated coefficient is close to zero, the diffuseness is high. Correspondingly, when the coefficient is close to one, the sound has a clear direction of arrival. Diffuse spatialization can be realized by conveying the processed sound to more loudspeakers at a time, and possibly by altering the phase of sound in different loudspeakers.

Figure 2:
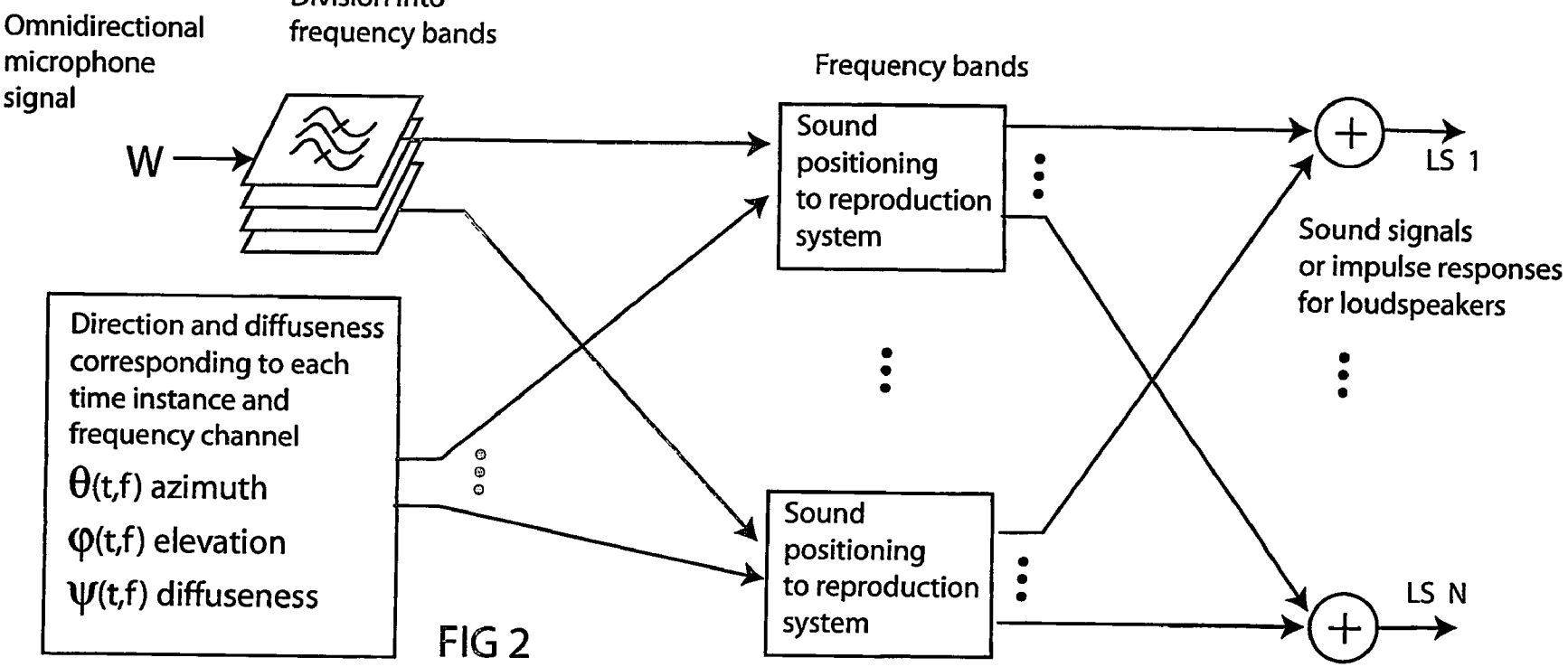

The following describes the invention as a list. In this case, the method to compute sound direction is based on sound intensity measurement, and positioning is performed with pair- or triplet-wise amplitude panning. Steps 1-4 are referring to FIG. 1 and steps 5-7 to FIG. 2.

1 The impulse response of an acoustical environment is measured or simulated, or continuous sound is recorded in an acoustical environment using one omnidirectional microphone (W) and a microphone system yielding the signals of three figure-of-eight microphones (X,Y,Z) aligned at the directions of the corresponding Cartesian coordinate axes. This can be realized, for instance, using a SoundField microphone.

2 The acquired responses or sound are divided into frequency bands, e.g., according to the resolution of human hearing.

3 At each frequency band, the active intensity of sound is estimated as a function of time.

4 The diffuseness of sound at each time instant is estimated based on the ratio of the magnitude of the active intensity and the sound power. Sound power is derived from the signal W.

5 At each time instant, the signal of each frequency band is panned to the direction determined by the active intensity vector.

6 If the diffuseness at a frequency band at a certain time instant is high, the corresponding part of the sound signal W is panned simultaneously to several directions.

7 The frequency bands of each loudspeaker channel at each time instant are combined, resulting in a multichannel impulse response or a multichannel recording.

The result can be listened to using the multichannel loudspeaker system that the panning was performed for. If an impulse response was processed, the resulting responses can be used in a convolution based reverberator to yield a spatial impression corresponding to that perceived in the recording space. Compared to Ambisonics, the invention provides several advantages:

1 Since a distinctly localizable sound event is always reproduced at most with two or three loudspeakers (in pair- and triplet-wise amplitude panning, respectively), the perceived spatial impression is sharper and less dependent on the listening position in a reproduction room.

2 For the same reason, the sound is less colored.

3 Only one high quality omnidirectional microphone is needed to acquire a high quality multichannel impulse response. The requirements for the microphones used in the intensity measurement are not as high.

The same advantages apply compared to the method using the same number of microphones and loudspeakers in sound recording and reproduction. Additionally:

4 From the data resulting from a single measurement it is possible to derive a multichannel response for an arbitrary loudspeaker system.

When processing impulse responses, the method also provides means to alter the produced reverberation. Most existing room acoustical parameters describe the time-frequency properties of measured impulse responses. These parameters can be easily modified by time-frequency dependent weighting during the reconstruction of a multichannel impulse response. Additionally, the amount of sound energy emanating from different directions can be adjusted, and the orientation of the sound field can be changed. Furthermore, the time delay between the direct sound and the first reflection (in reverberation terms pre-delay) can be customized according to the needs of current application.

Other Application Areas

A method according to the invention can also be applied to audio coding of multichannel sound. Instead of several audio channels, only one channel and some side information are transmitted. Christof Faller and Frank Baumgarte [7, 8] have proposed a less advanced coding method that is based on analyzing the localization cues from a multichannel signal. In audio coding applications, the processing method produces a somewhat reduced quality compared to the reverberation application, unless the directional accuracy is deliberately compromised. Nevertheless, especially in video and teleconferencing applications the method can be used to record and transmit spatial sound.

Operation

It has been shown that in sound reproduction amplitude panning produces better ITD and ILD cues than Ambisonics [9]. Amplitude panning has for a long time been a standard method for positioning a non-reverberant sound source in a chosen point between loudspeakers. A method according to the invention improves the reproduction accuracy of a whole acoustical environment.

The performance of the proposed system has been evaluated in formal listening tests using a 16-channel loudspeaker system including loudspeakers above the listener, as well as using a 5.1 setup. Compared to Ambisonics, the spatial impression is more precise and the sound is less colored. The spatial impression is close to the measured acoustical environment.

Loudspeaker reproduction of the acoustics of a concert hall using the proposed method has also been compared to binaural headphone reproduction of recordings made with a dummy head in the same hall. Binaural recording is the best known method to reproduce the acoustics of an existing space. However, high quality reproduction of binaural recordings can only be realized with headphones. Based on comments of professional listeners, the spatial impression was in both cases nearly the same, but in the loudspeaker reproduction the sound was better externalized.

The detailed realization of the invention is illustrated with the following example:

1 The impulse responses of the Finnish Oopperatalo or any other performance space are measured such that the sound source is located at three positions on the stage and the microphone system at three positions in the audience area=9 responses. Equipment: standard PC; multichannel sound card, e.g. MOTU 818; measurement software, e.g. Cool Edit pro or WinMLS; microphone system, e.g. SoundField SPSS 422B.

2 The loudspeaker system for reproduction is defined, for instance 5.1 standard without the middle loudspeaker. In this example the middle loudspeaker is left out because the reverberation is reproduced with a four-channel reverberator.

3 With a software accordant with the invention, impulse responses are computed for all loudspeakers corresponding to each source-microphone combination.

4 Desired source material is convolved with the impulse responses corresponding to one source-microphone combination and the resulting sound is assessed. The sound impression of different source-microphone combinations can be compared in order to choose the one most suitable for current application. Additionally, using several source positions, different source material can be positioned at different locations in the sound field. Equipment can consist of a standard PC or of a convolving reverberator, e.g. Yamaha SREV1; in this case additionally four loudspeakers.

REFERENCES

[1] Farina, A. & Ayalon, R. Recording concert hall acoustics for posterity. AES 24th International Conference on Multichannel Audio.

[2] Merimaa J. Applications of a 3-D microphone array. AES 112$^{th}$ Conv. Munich, Germany, May 10-13, 2002. Preprint 5501.

[3] Pulkki V. Localization of amplitude-panned virtual sources II: Two- and three-dimensional panning. J. Audio Eng. Soc. Vol. 49, no 9, pp. 753-767. 2001.

[4] Gerzon M. A. Periphony: With-height sound reproduction. J. Audio Eng. Soc. Vol 21, no 1, pp. 2-10. 1973

[5] Berkhout A. J. A wavefield approach to multichannel sound. AES 104$^{th}$ Conv. Amsterdam, The Netherlands, May 16-19, 1998. Preprint 4749.

[6] Begault D. R. 3-D sound for virtual reality and multimedia. Academic Press, Cambridge, Mass. 1994.

[7] Faller C. & Baumgarte, F. Efficient representation of spatial audio using perceptual parameterization. IEEE Workshop on Appl. of Sig. Proc. to Audio and Acoust., New Paltz, USA, Oct. 21-24, 2001.

[8] Faller C. & Baumgarte, F. Binaural cue coding applied to stereo and multichannel audio compression. AES 112$^{th}$ Conv. Munich, Germany, May 10-13, 2002. Preprint 5574.

[9] Pulkki, V. Microphone techniques and directional quality of sound reproduction. AES 112$^{th}$ Conv. Munich, Germany, May 10-13, 2002. Preprint 5500.

The invention claimed is:

1. A method to acquire signals, the method comprising the steps of:

using hardware, measuring an omnidirectional response of a sound signal;

using the hardware, determining a vector indicating a direction of arrival of the sound as a function of time individually for different frequency bands as steer data for the sound signal; and using the hardware, transmitting or recording the omnidirectional response of the sound signal together with side information derived from the steer data.

2. A method in accordance with claim 1, further comprising the step of:

determining the diffuseness of sound for each frequency band.

3. A method in accordance with claim 1, further comprising the step of:

measuring the sound signal with a set of directional microphones that enable to measure the arrival of the sound with different directional responses.

4. A method in accordance with claim 3, in which the set of microphones provides three directional responses in directions of the axes of a Cartesian coordinated system.

5. A method in accordance with claim 3, wherein determining the direction of arrival of the sound comprises:

dividing the sound signal measured with each directional response into the different frequency bands; and deriving the steer data for each of the frequency bands using the directional responses of the corresponding frequency band.

6. A method in accordance with claim 5, in which the sound signal measured with the set of microphones is filtered with a filterbank or using a short-time Fourier Transform.

7. A method in accordance with claim 5, wherein deriving the steer data comprises:

deriving an active intensity of the sound within each frequency band for each directional response; and deriving the direction of arrival using the active intensities of each directional response.

8. A method for reproducing the spatial impression of an existing acoustical environment for reproduction with a multichannel loudspeaker system, comprising the steps of:

receiving a monophonic sound signal recorded with omnidirectional response together with a vector indicating a direction of arrival of sound as a function of time individually for different frequency bands;

dividing the monophonic sound signal into the predetermined frequency bands, the vector being steer data for the monophonic sound signal;

distributing the sound signal of each frequency band to loudspeaker channels of the multichannel loudspeaker system in the directions indicated by the steer data; and combining the frequency bands of each loudspeaker channel to derive a signal that can be reproduced by a loudspeaker associated to the channel.

9. A method in accordance with claim 8, wherein the distributing comprises amplitude panning, ambisonics, wave field synthesis or binaural processing.

10. A method in accordance with claim 8, wherein the signal of each frequency band is distributed to two or three loudspeaker channels.

11. A method in accordance with claim 8, further comprising the step of:

simultaneously distributing the signal of a frequency band of the monophonic sound signal with the omnidirectional response to multiple loudspeaker channels, when an estimated diffuseness of the frequency band of the omnidirectional response of the sound signal is high.

12. A method in accordance with claim 11, further comprising the step of:

altering the phase of the sound signal distributed to loudspeaker channels in different directions.

13. An apparatus to acquire signals, the apparatus comprising:

an omnidirectional microphone for measuring an omnidirectional response of a sound signal;

a set of microphones for measuring a direction of arrival of the sound signal;

means for determining a vector indicating a direction of arrival of the sound as a function of time individually for different frequency bands as steer data for the sound signal; and means for transmitting or recording the omnidirectional response of the sound signal together with side information derived from the steer data.

14. An apparatus for reproducing the spatial impression of an existing acoustical environment for reproduction with a multi-channel loudspeaker system, comprising:

means for receiving a monophonic sound signal recorded with omnidirectional response together with a vector indicating a direction of arrival of sound as a function of time individually for different frequency bands, the vector being steer data for the monophonic sound signal;

means for dividing the monophonic sound signal into predetermined frequency bands; and a sound positioner adapted to distribute the sound signal of each frequency band to loudspeaker channels of the multichannel loudspeaker system in the directions indicated by the steer data.

15. A computer readable storage medium having stored thereon a computer program for, when running on a computer, implementing the method of claim 1.

16. A computer readable storage medium having stored thereon a computer program for, when running on a computer, implementing the method of claim 8.

17. A method for acquiring an impulse response of an acoustical environment, the method comprising the steps of:

using hardware, measuring an omnidirectional response of the impulse response;

using the hardware, determining a vector indicating a direction of arrival of the impulse response as a function of time individually for different frequency bands as steer data for the impulse response; and using the hardware, transmitting or recording the omnidirectional response of the impulse response together with side information derived from the steer data.

18. A method for using an impulse response of an existing acoustical environment for a multichannel loudspeaker system, comprising the steps of:

receiving a monophonic impulse response signal measured with omnidirectional response together with a vector indicating a direction of arrival of sound as a function of time individually for different frequency bands, the vector being steer data for the monophonic sound signal;

dividing the monophonic impulse response into predetermined frequency bands;

distributing the impulse response signal of each frequency band to loudspeaker channels of the multichannel loudspeaker system in the directions indicated by the steer data; and combining the frequency bands of each loudspeaker channel to derive impulse responses that can be used by a loudspeaker associated to the channel.

19. A method in accordance with claim 18, further comprising the steps of:

receiving desired source material;

convolving the desired source material with the impulse responses of each loudspeaker channel to derive convolved source material; and playing back the convolved source material using the loudspeakers associated to the impulse responses used generating the convolved source material.

20. A method for creating natural or modified spatial impression in multichannel listening, comprising the steps of:

a) the impulse response of an acoustical environment being measured or continuous sound being recorded using multiple microphones: one omnidirectional microphone (W) and multiple directional or omnidirectional microphones;

b) the microphone signals being divided into frequency bands according to the frequency resolution of human hearing;

c) based on the microphone signals, a vector indicating the direction of arrival and optionally diffuseness of sound being determined individually for each frequency band at each time instant;

d) the monophonic sound of the omnidirectional microphone (W) being transmitted or recorded together with side information derived from the direction of arrival;

e) receiving the monophonic sound and the side information;

f) dividing the monophonic sound into the frequency bands;

g) distributing the sound of each frequency band to predetermined loudspeaker channels in the directions indicated by the steer data; and h) combining the frequency bands of each loudspeaker channel to derive a signal that can be reproduced by a loudspeaker.

21. A method according to claim 20, wherein the frequency bands and time instants of a omnidirectional signal (W) corresponding to non-zero diffuseness are positioned simultaneously to two or more directions in order to create a spatial impression corresponding to a real acoustical space.

22. A method according to claim 21, wherein two or more decorrelated versions of the omnidirectional signal (W) are created and reproduced simultaneously from two or more directions at frequency bands and time instants corresponding to high diffuseness.

23. A method according to claim 21, wherein the frequency bands applied to each loudspeaker channel are combined in order to produce an impulse response or sound signal for each loudspeaker channel.

24. A method according to claim 20, wherein the processed impulse responses or parts of the processed impulse responses are used to produce reverberation with convolution or by modeling the responses with digital filters.

* * * * *